US005161885A

United States Patent [19]

Segaud et al.

[11] Patent Number: 5,161,885

[45] Date of Patent: Nov. 10, 1992

[54] INTERMEDIATE SCREEN FOR A SIGNAL LIGHT

[75] Inventors: Daniel Segaud, Paris; Bernard Mauroy, Roissy sur Brie, both of France

[73] Assignee: Valeo Vision, Bobigny, France

[21] Appl. No.: 676,826

[22] Filed: Mar. 28, 1991

[30] Foreign Application Priority Data

Mar. 30, 1990 [FR] France ..... 90 04088

[51] Int. Cl.[5] ..... F21V 5/00

[52] U.S. Cl. ..... 362/332; 362/61; 362/309; 362/333; 362/339

[58] Field of Search ..... 362/61, 80, 308, 309, 362/336, 338, 334, 340, 327, 332, 339, 333

[56] References Cited

U.S. PATENT DOCUMENTS

| | | | |
|---|---|---|---|
| 1,787,443 | 1/1931 | Falge | 362/332 |
| 3,798,444 | 3/1974 | Brudy | 362/328 |
| 4,823,246 | 4/1989 | Dilouya | 362/328 |
| 4,972,302 | 11/1990 | Masuyama et al. | 362/327 X |

*Primary Examiner*—Stephen F. Husar

[57] ABSTRACT

The invention provides an intermediate screen for a signal light, the screen being of the type constituted by a plate for passing a flux of light, and including a set of light-deflecting grooves on at least one of its faces, the grooves being essentially concentric and each being defined by two faces of essentially rectilinear profile and of given angles of inclination relative to the normal to the plate. For at least one subset of adjacent grooves, the angles of inclination of the faces defining each groove vary from one groove to another and are such that the sum of said angles is constant.

9 Claims, 2 Drawing Sheets

INTERMEDIATE SCREEN FOR A SIGNAL LIGHT

The present invention relates in general to signal lights, in particular for motor vehicles, and in relates more particularly to a novel intermediate screen for a signal light and to a novel method of manufacture.

BACKGROUND OF THE INVENTION

Some prior art signal lights comprise a filament lamp, an intermediate screen, and a closure glass or globe. Where appropriate, a mirror may be provided to recover a maximum amount of the light flux which the lamp emits away from the screen and the glass.

Traditionally, the purpose of the intermediate screen is to deflect the light rays received from the lamp (and from the mirror if any) so that the resulting beam that is formed satisfies a given photometric distribution. This must be done in such a manner as, to ensure that the brightness of the light when observed from the outside appears to be as uniform as possible.

It is thus known to provide (preferably concentric) grooves on the inside and/or outside surface of the intermediate screen, with the profiles of respective grooves being designed in such a manner as to provide deflection by refraction or by total reflection that is accurately adapted to the propagation direction of the light rays received from the lamp, and from the mirror, if any.

It will thus be understood that it is extremely fiddly, lengthy, and expensive to make the dies for manufacturing such intermediate screens (which are generally made of molded plastic material which may be transparent or colored). More precisely, it is necessary for each groove or limited group of grooves to adjust the cutting angle of the tool as a function of the prism angles that are to be given to each groove.

In addition, in order to be able to engrave the faces of grooves down to the bottoms of deep grooves between grooves, it is necessary to use a tool which is extremely narrow, and which is consequently fragile.

The present invention seeks to mitigate these drawbacks of the prior art and to provide an intermediate screen which is much easier and cheaper to make, which nevertheless giving satisfactory results, optically speaking.

SUMMARY OF THE INVENTION

To this end, a first aspect of the present invention provides an intermediate screen for a signal light, the screen being of the type constituted by a plate for passing a flux of light, and including a set of light-detecting grooves on at least one of its faces, the grooves being essentially concentric and each being defined by two faces of essentially rectilinear profile and of given angles of inclination relative to the normal to the plate, wherein for at least one subset of adjacent grooves the angles of inclination of the faces defining each groove vary from one groove to another and are such that the sum of said angles is constant.

In this manner, as explained below, all of the grooves of the, or each, subset may be made by engraving a mold with a single cutting tool having two cutting edges at well-determined mutual inclinations, or with a very small number of such tools.

Preferred but not-limiting features of the intermediate screen of the invention are specified below:

it includes two lateral zones each having grooves whose faces have angles of inclination that remain essentially constant from one groove to the next;

it further includes a central zone having a first sub-zone of grooves having varying angles or inclination for their faces, with a sum that is equal to a first predetermined value, and a second sub-zone of grooves having varying angles of inclination for their faces, with a sum that is equal to a second predetermined value;

the two sub-zeros of the central zone are separated from each other by a transition line which is essentially circular and concentric with the grooves;

the lateral zones are separated from the central zone by transitions that are essentially vertical and rectilinear; and grooves are provided on both faces of the plate.

In a second aspect, the invention provides a method of machining a half-mold for molding intermediate screen as defined above, the method comprising the following steps for making at least one group of mold recesses corresponding to a subset of grooves on the screen:

a) making a first essentially circular recess in one or more passes by means of a cutting tool having two cutting edges at a determined angle relative to each other, and by rotating the half-mold about an axis passing through a reference center of the half-mold;

b) causing the cutting tool to pivot through a determined angle in a plane substantially including said axis of rotation and the cutting tool; and repeating steps a) and b) to make all of the recesses of the group one after another.

Finally, in a third aspect, the invention provides a method of machining a half-mold for molding intermediate screen in the form of a plate and of the type defined above, the method including the following step for making at least one group of mold recesses corresponding to a subset of screen grooves:

using one or more passes of a cutting tool having two cutting edges at a determined angle to each other to make a single spiral recess by rotating the half-mold about an axis passing through a reference center of the half-mold while continuously displacing the cutting tool linearly in a radial direction relative to the reference center, and while simultaneously also continuously varying the angle of inclination of the tool in a plane substantially including said axis of rotation and the cutting tool.

BRIEF DESCRIPTION OF THE DRAWINGS

An embodiment of the invention is described by way of example with reference to the accompanying drawings, in which.

DETAILED DESCRIPTION

It is mentioned initially that items or portion which are identical or similar from one figure to another are designated in all of them by the same references.

Figure 1:
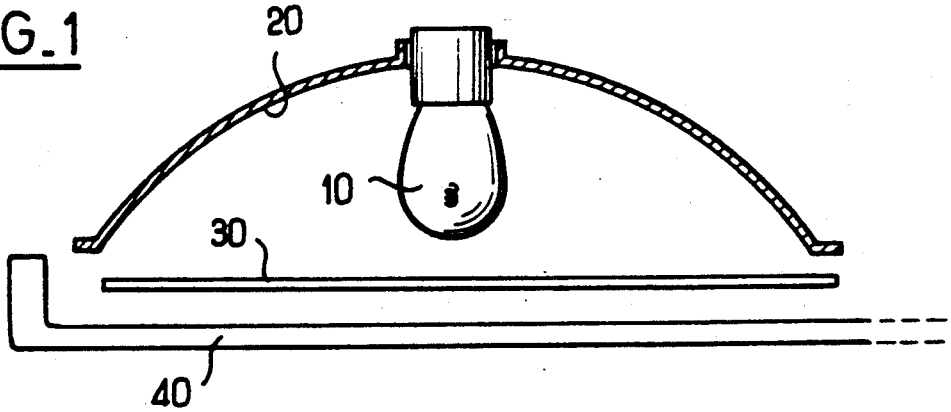
FIG. 1 is a diagrammatic overall view in horizontal section through a signal light including an intermediate screen.

With references initially to FIG. 1, a motor vehicle signal light is shown comprising a lamp 10, a reflector 20, an intermediate screen 30, and a closure glass or globe 40. The reflector serves in conventional manner to recover light flux emitted towards the back of the light. The purpose of the intermediate screen is to deflect the light rays received directly from the lamp so that they participate in forming a beam, and the screen is designed in such a manner that rays reflected by the reflector 20 also continue to participate in the beam after going through the said screen, i.e. they are not excessively deflected laterally. Conventionally, the intermediate screen 30 comprises a series of concentric grooves all centered on a reference center C which is the normal projection of the source on the screen, with the grooves preferably being narrow (of the order of a fraction of a millimeter wide to one millimeter wide). With wider grooves, alternating light and dark concentric circles become visible when the light is switched on, and this is not desirable, particularly from the point of view of appearance.

Each groove has a V-shaped profile, and it may be defined firstly by its width L, and secondly by angles $\alpha$ and $\beta$ of its two faces which are sloping and rectilinear in profile, i.e. which are conical.

The inside surface of the glass 40 preferably includes a series of beads or the like for making the resulting light beam more uniform.

An intermediate screen 30 constituting a preferred embodiment of the invention is now described in greater detail with reference ot FIGS. 2 to 5. In the present example, the screen 30 includes three distinct zones referenced Z1, Z2, and Z3 and which are separated by vertical transitions T12 and T23.

Each of the laterally outer zones Z1 and Z2 includes a series of concentric grooves on the inside surface of the plate P constituting the screen 30. The grooves S1 in the zone Z1 are all identical in the present example, i.e. the associated parameters L1, $\alpha 1$, and $\beta 1$ are the same for all of the grooves S1. Similarly, the grooves S3 in the zone Z3 all have the same parameters L3, $\alpha 3$, and $\beta 3$.

According to an essential feature of the invention, at least one zone of the screen, in this case the central zone Z2, includes grooves that may be characterized by the fact that their angles $\alpha 2$ nd $\beta 2$ vary from one groove to another, while the sum $\alpha 2+\beta 2$ nevertheless remains constant.

In this example, the zone Z2 is subdivided into two sub-zones Z2' and Z2'' respectively constituting an inner zone and an outer zone with the transition between the two sub-zones taking place along a circular line L2 which is situated at the transition between two adjacent grooves.

The zone Z2' includes grooves S2' open at an angle (sum of the angles $\alpha 2$ and $\beta 2'$) equal to a first value $\theta 2'$, whereas the zone Z2'' includes grooves S2'' that are open at an angle $\theta 2''=\alpha 2''+\beta 2''$ which is equal to a second value that differs from the first value $\theta 2'$, and that is smaller in the present case.

Figure 5:
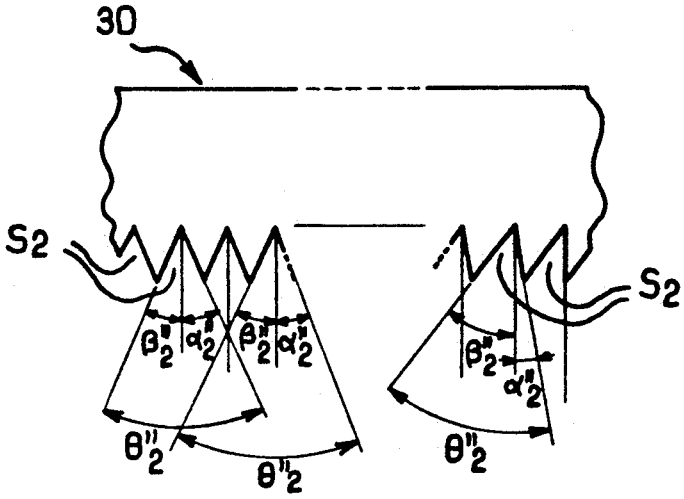
FIG. 5 shows another detail of the screen of FIG. 3, but on the larger scale.
Figures 2, 3, 4:
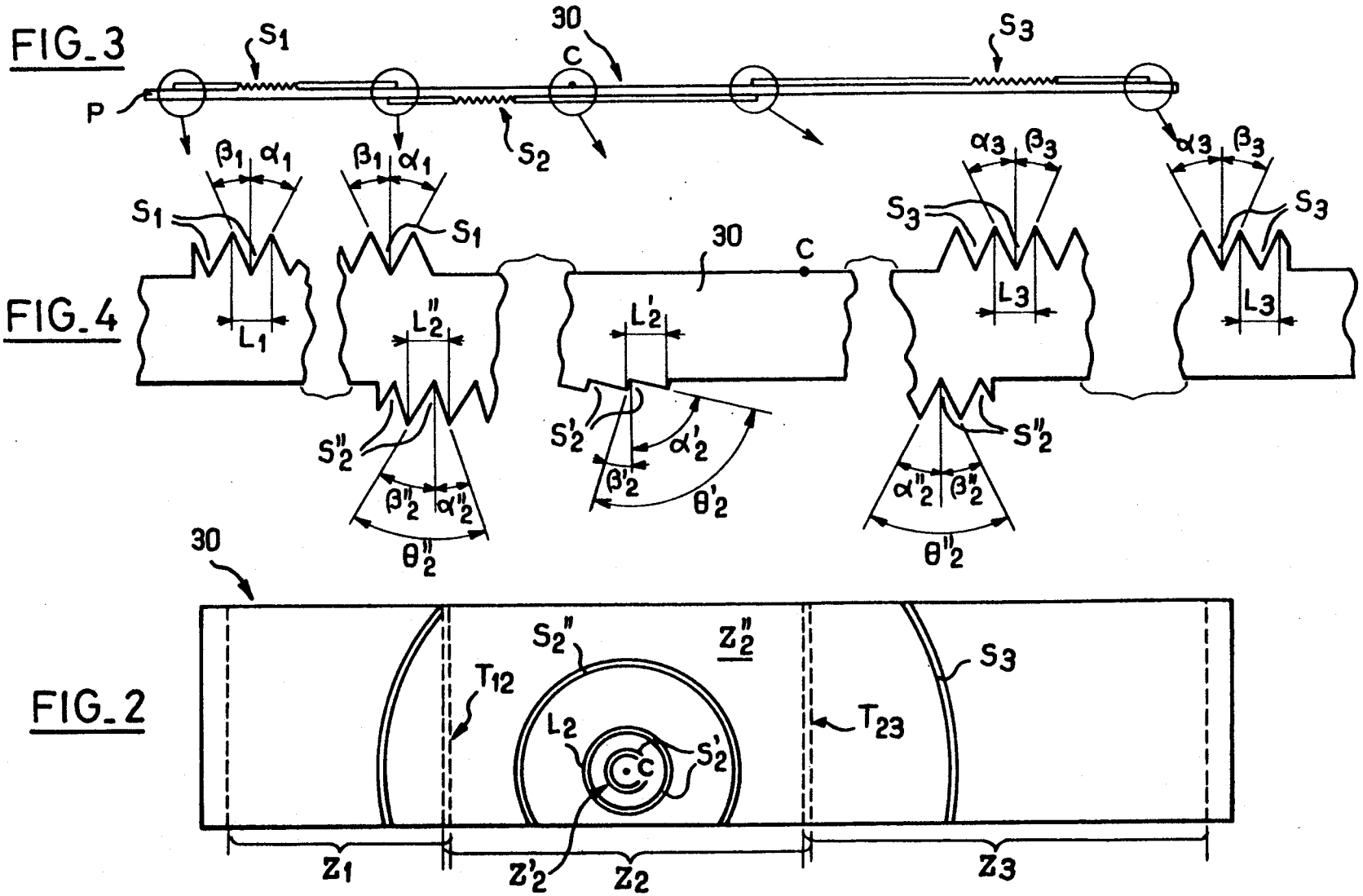
FIG. 2 is a diagrammatic elevation view of the intermediate screen.
FIG. 3 is a horizontal section through the screen of FIG. 2.
FIG. 4 shows several details of the screen of FIG. 3, but on a larger scale.

The detail of FIG. 5 is a radial section through a portion of sub-zero Z2''. It can be seen that the angles $\alpha 2''$ and $\beta 2''$ vary in monotonic progression from one groove to the next, with the angle $\alpha 2''$ decreasing with increasing distance from the reference point C while the angle $\beta 2''$ increases. However, throughout this sub-zone, the sum $\alpha 2''+\beta 2''$ remains constant.

The behavior of the grooves S2' in the zone Z2' is similar, except that they open an angle $\theta 2'$ which is different and the width L2' of the grooves may also be different.

Naturally, although only the central zone Z2 of the screen in the example shown has grooves of varying profile, the other zones of the screen could also have such grooves.

The above description is made with reference to grooves that are circular and concentric. However, the invention naturally also applies to juxtaposed grooves constituted in practice by a single groove extending in a spiral (and although such a case has only one groove, the present description continues to be written in terms of a plurality of grooves that are "side by side", for reasons of simplicity).

With a spiral of grooves, the angles $\alpha$ and $\beta$ characterizing each groove may vary either continuously and progressively along the groove, or else in steps, e.g. once every turn through 360°. It will be understood that the same result is then obtained as is obtained with concentric groove, namely that from one groove to the next, the characteristic angles $\alpha$ and $\beta$ change but the characteristic sum $\alpha+\beta$ likewise equals a constant for all of the grooves in a given subset.

A particular advantage of the present invention lies in that in order to machine a half-mold for the purpose of enabling screens to be mass produced, the negatives of the various grooves (e.g. S2'') may be made using a single cutting tool having two cutting edges that are inclined relative to each other at an appropriate angle determined as a function of $\theta 2''$ and of the rate at which the angles $\alpha 2''$ and $\beta 2''$ change, with the inclination of the tool relative to the normal merely being altered on going from engraving one mold groove or recess (corresponding to the ridge between two grooves in the screen) to engraving the following recess.

Figure 6:
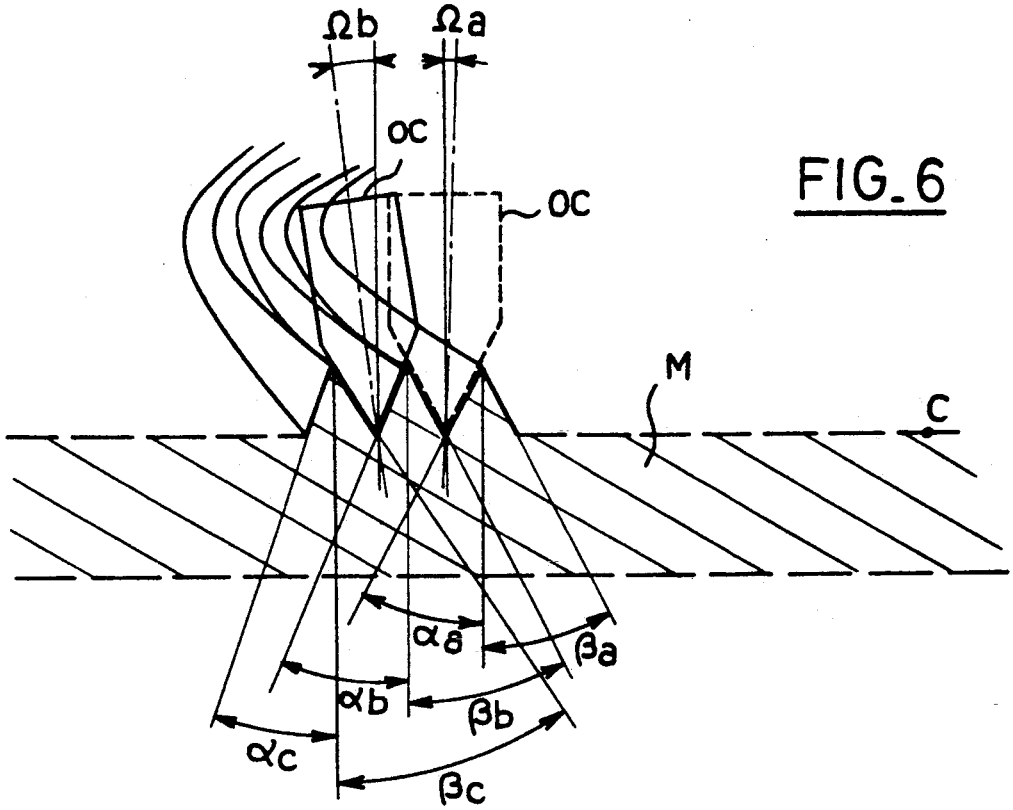
FIG. 6 is a diagrammatic perspective view illustrating a first method of the invention for making a half-mold for an intermediate screen.

This method is shown diagrammatically in FIG. 6. In conventional manner, each recess is made by rotating the mold M about an axis A perpendicular to the plane of the screen to be made and passing through the reference center C, while the cutting tool OC is held stationary. To make the following recess (assumed to be further away from the center C), the tool is merely raised and moved away from the point C by the appropriate distance equal to the groove pitch.

According to the invention, the mold is made by using the above process, but in addition altering the inclination of the cutting tool OC on going from machining one recess to the next. Thus, FIG. 6 shows that for machining recess Sa, the cutting tool OC (shown in dashed lines) is inclined relative to the normal to the surface in a radial plane containing C by a certain angle $\Omega a$ which is adapted to the desired angles $\alpha a$ and $\beta b$. To make the following recess, the inclination of the cutting tool is changed to become $\Omega b$, adapted to the angles now require: $\alpha b$ and $\beta c$.

The method of making the mold is thus not substantially more complicated than conventional techniques since all that is required is for the angular position of the tool to be changed in addition to the tool being displaced linearly in a radial direction when going from one recess to the next.

Depending on the size of the open angle of the grooves, and depending on the nature of the material from which the mold is made, each recess may be machined either in a single pass, or else in a plurality of passes. In both cases the advantage of not having to change the tool is retained.

A variant of the method of manufacturing a mold according to the invention is now described, still with reference to FIG. 6. In this variant, each zone of mold recesses constitutes a single spriral recess. In this case, the recess is made without having to raise the cutting tool to go from one recess to the next, but while displacing said tool radially as a linear function of the absolute angle of rotation of the mold about the point C. In this case, the radial rectilinear displacement of the tool is combined with pivoting of the tool about an axis which is substantially perpendicular to the radial plane perpendicular to the surface of the mold, containing the reference center C, and passing close to the tool. In the present example, the angle of inclination of the tool OC changes progressively from the value Ωa to the value Ωb when the mold rotates through 360°.

In a particular embodiment of the invention, all of the grooves on the intermediate screen 30 have the same width. Naturally, they could have different widths.

The present invention is naturally not limited to the embodiment described above and shown in the drawings, and the person skilled in the art will be able to make numerous variants and modifications thereto within the scope of the invention.

In particular, the person skilled in the art will be able to use the teaching of the present invention to make intermediate screens of all types, with any number and disposition of groove zones, at least one of which has grooves of constant opening but of inclinations that vary from one groove to the next. The values of the various groove parameters used for designing the screen are essentially determined as a function of the nature and of the dispositon of the source and of the reflector, and of the type of light signal that is to be formed, and these parameters may vary very widely.

In addition, it is naturally possible to use an intermediate screen which is common to a set of signal lights disposed side by side. Given the accuracy of presently available numerically controlled machine tools, it is also possible to envisage implementing the present invention in intermediate screens that are not flat and which may include portions that are highly curved, in particular in the corner regions of rear light blocks.

Finally, the grooves made in accordance with the present invention may have a profile which is other than circular or spiral, obtained, for example, by controlled radial displacement of the cutting tool during rotation of a mold that is being engraved.

We claim:

1. An intermediate screen for a signal light, the screen comprising a plate for passing a flux of light and including a set of light-deflecting grooves on at least one of its faces, the grooves being essentially concentric and each being defined by two faces of essentially rectilinear profile and of given angles of inclination relative to an axis which is perpendicular to the plate, wherein for at least one subset of adjacent grooves the angles of inclination of the faces defining each groove vary from one groove to another and are such that the sum of said angles is constant.

2. A screen according to claim 1, including a central zone and two lateral zones having different groove arrangements, wherein each lateral zone has grooves whose faces have angles of inclination that remain essentially constant from one groove to the next.

3. A screen according to claim 2, wherein said central zone has a first subzone pf grooves having varying angles of inclination for their faces, with a sum that is equal to a first predetermined value, and a second subzone of grooves having varying angles of inclination for their faces, with a sum that is equal to a second predetermined value.

4. A screen according to claim 3, wherein the two sub-zones of the central zone are separated from each other by a transition line which is essentially circular and concentric with the grooves.

5. A screen according to claim 3, wherein the lateral zones are separated from the central zone by transitions that are essentially vertical and rectilinear.

6. A screen according to claim 1, wherein grooves are provided on both faces of the plate.

7. A method of machining a half-mold for molding an intermediate screen for a signal light, the screen comprising a plate for passing a flux of light, and including a set of light-deflecting grooves on at least one of its faces, the grooves being essentially concentric and each being defined by two faces of essentially rectilinear profile and of given angles of inclination relative to an axis which is perpendicular to the plate, wherein for at least one subset of adjacent grooves the angles of inclination of the faces defining each groove vary from one groove to another and are such that the sum of said angles is constant; the method comprising the following steps for making at least one group of mold recesses corresponding to a subset of screen grooves:

a) making a first essentially circular recess in one or more passes by means of a cutting tool having two cutting edges at a predetermined angle relative to each other, and by rotating the half-mold about an axis passing through a reference center of the half-mold;

b) causing the cutting tool to pivot through a predetermined angle in a plane substantially including said axis of rotation and the cutting tool; and repeating steps a) and b) to make all of the recesses of the group one after another.

8. A method of machining a half-mold for molding an intermediate screen for a signal light, the screen comprising a plate for passing a flux of light, and including a set of light-deflecting grooves on at least one of its faces, the grooves being essentially concentric and each being defined by two faces of essentially rectilinear profile and of given angles of inclination relative to an axis which is perpendicular to the plate, wherein for at least one subset of adjacent grooves the angles of inclination of the faces defining each groove vary from one groove to another and are such that the sum of said angles is constant; the method including the following step for making at least one group of mold recess corresponding to a subset of screen grooves:

using one or more passes of a cutting tool having two cutting edges at a predetermined angle to each other to make a single spiral recess by rotating the half-mold about an axis passing through a reference center of the half-mold while continuously displacing the cutting tool linearly in a radial direction relative to the reference center, and while simultaneously also continously varying the angle of inclination of the tool in a plane substantially including said axis of rotation and the cutting tool.

9. A signal light, in particular for a motor vehicle, including a light source, a closure glass, and an intermediate screen for a signal light, the screen comprising a plate for passing a flux of light, and including a set of light-deflecting grooves on at least one of its faces, the grooves being essentially concentric and each being defined by two faces of essentially rectilinear profile and of given angles of inclination relative to an axis which is perpendicular to the plate, wherein for at least one subset of adjacent grooves the angles of inclination of the faces defining each groove vary from one groove to another and are such that the sum of said angles is constant.

* * * * *